US006112337A

United States Patent [19]

Brod

[11] Patent Number: 6,112,337

[45] Date of Patent: Sep. 5, 2000

[54] SAFETY DEVICE

[76] Inventor: Walter V. Brod, 2503 138th Ave. NW., Andover, Minn. 55304

[21] Appl. No.: 09/282,481

[22] Filed: Mar. 31, 1999

[51] Int. Cl.[7] ..... E03D 11/00

[52] U.S. Cl. ..... 4/254; 4/661

[58] Field of Search ..... 4/254, 661, 604, 4/576.1, 577.1

[56] References Cited

U.S. PATENT DOCUMENTS 2,814,336 11/1957 Manhart et al. .
4,015,878 4/1977 Perkins .
4,128,924 12/1978 Happel et al. .
4,819,278 4/1989 Ramos .
4,846,527 7/1989 Julien et al. .
5,027,446 7/1991 Robertson .
5,492,285 2/1996 Hamrick .
5,738,112 4/1998 Brod .

*Primary Examiner*—Charles E. Phillips
*Attorney, Agent, or Firm*—Merchant & Gould P.C.

[57] ABSTRACT

The present disclosure relates to a safety system including first and second elongated tracks adapted for connection to a wall. A first housing is mounted on and slidably moveable along the first track. A first safety belt is retractably mounted within the first housing, and a first coupling structure is connected to the first safety belt. The safety system also includes a second coupling structure slidably movable along the second track. The second coupling structure is adapted to interlock with the first coupling structure.

10 Claims, 1 Drawing Sheet

SAFETY DEVICE

FIELD OF THE INVENTION

The present invention relates generally to safety devices. More particularly, the present invention relates to safety devices that use retractable belts to prevent individuals from falling and sustaining injuries.

BACKGROUND OF THE INVENTION

For people who lack sufficient muscle strength or muscle coordination to maintain a seated posture, using a toilet can be dangerous. For such people, additional support is required to prevent them from falling from the toilet and potentially physically hurting themselves. Typically, such individuals must depend upon another person to provide physical support while they are using the toilet facility.

U.S. Pat. No. 5,738,112 to Brod, which is hereby incorporated by reference, discloses a toilet safety device including a housing adapted to be fixedly mounted on a wall behind a toilet. Two belts are retractably mounted within the housing. To provide support to a person seated on the toilet, the belts are pulled from the housing, looped under the person's arms, and fastened across the person's chest.

SUMMARY OF THE INVENTION

One aspect of the present invention relates to a safety device including an elongated track adapted to be mounted on a wall. This safety device also includes a first housing that is slidably movable along the track. The safety device further includes a first safety belt retractably mounted within the first housing.

Another aspect of the present invention relates to a safety system including first and second elongated tracks adapted for connection to a wall. A first housing is mounted on and slidably movable along the first track. A first safety belt is retractably mounted within the first housing. A first coupling structure is connected to the first safety belt. The first coupling structure is adapted to interlock with a second coupling structure that is slidably moveable along the second track.

A further aspect of the present invention relates to a method for stabilizing a person on a toilet. The method includes providing a first housing positioned at a first side of the toilet. The method also includes providing a retractable first safety belt mounted within the first housing, the first safety belt including a first coupling structure. The method further includes providing a second coupling structure at a second side of the toilet that is opposite from the first side. The method additionally includes adjusting an elevation of the first housing relative to the person, adjusting an elevation of the second coupling structure relative to the person, and interlocking the first and second coupling structures such that the first safety belt assists in stabilizing the person.

A variety of advantages of the invention will be set forth in part in the description that follows, and in part will be apparent from the description, or may be learned by practicing the invention. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several aspects of the invention and together with the description, serve to explain the principles of the invention. A brief description of the drawings is as follows.

DETAILED DESCRIPTION OF THE PREFERRED EMBODIMENT

Reference will now be made in detail to exemplary aspects of the present invention that are illustrated in the accompanying drawings. Wherever possible, the same reference numbers will be used throughout the drawings to refer to the same or like parts.

Figure 1:
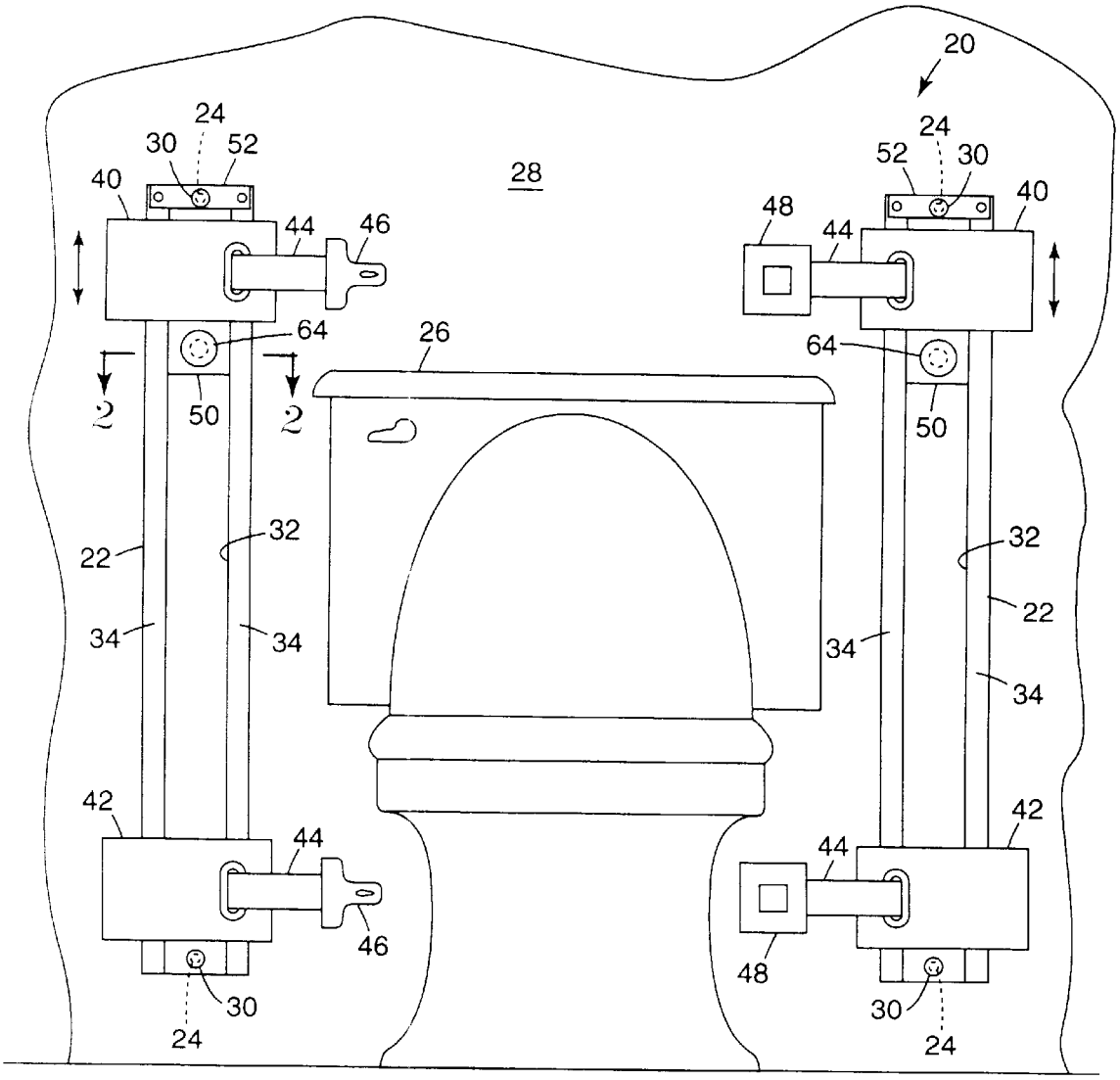
FIG. 1 illustrates a safety device constructed in accordance with the principles of the present invention, the safety device is shown mounted on a wall behind a toilet.

FIG. 1 shows a safety device 20 constructed in accordance with the principles of the present invention. The safety device 20 includes two elongated tracks 22 adapted for connection to a wall. For example, the tracks 22 are shown including bolt holes 24 for allowing the tracks 22 to be bolted or otherwise anchored to a wall. Of course, other techniques such as mounting brackets could also be used in connecting the elongated tracks 22 to a wall.

As shown in FIG. 1, the elongated tracks 22 are mounted on opposite sides of a toilet 26. The tracks 22 are each mounted in a generally vertical orientation and are connected to a wall 28 located behind the toilet 26. As shown in FIG. 1, the tracks 22 are connected to the wall 28 by anchoring members 30 (e.g., bolts, screws, toggles or other known fasteners) that extend into the wall 28 through the bolt holes 24 defined by the tracks 22.

Figure 2:
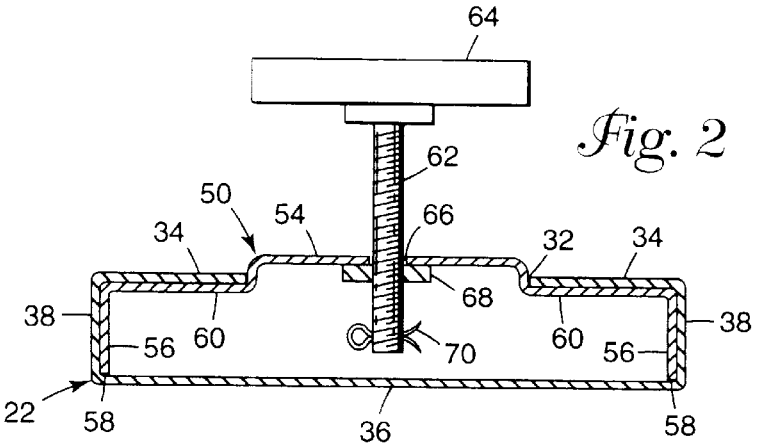
FIG. 2 shows a cross sectional view taken along section line 2—2 of FIG. 1.

Referring again to FIG. 1, each track 22 defines an elongated front slot 32. FIG. 2 shows a cross sectional view cut through one of the tracks 22. As shown in FIG. 2, the track 22 is preferably made of a sheet-like material (e.g., a sheet or plate of stainless steel) that is bent to a desired configuration. The track 22 includes two spaced-apart front flanges 34 that define the elongated slot 32. A base portion 36 is generally parallel to and opposes the front flanges 34. Side walls 38 interconnect the front flanges 34 to the base portion 36.

Referring back to FIG. 1, upper and lower housings 40 and 42 are mounted on each of the tracks 22. The housing 40 and 42 are preferably made of a substantially rigid material such as stainless steel and are preferably generally box shaped. Safety belts 44 are retractably mounted within each of the housings 40 and 42. For example, each of the housings 40 and 42 preferably includes the conventional take-up mechanism for retracting the belts 44 within the housings 40 and 42. A preferred seat belt assembly including take-up mechanisms is distributed by Indiana Mills and Manufacturing Inc. of Carmel, Ind.

The safety belts 44 preferably include coupling structures for allowing the safety belts 44 to be interconnected. For example, the belts 44 associated with the left track 22 include tongues 46, while the belts 44 associated with the right track 22 include buckles 48 adapted to selectively interlock with the tongues 46.

It is preferred for the upper housings 40 to be slidably moveable along the tracks 22. By sliding the upper housings 40 along the tracks 22, the elevation of the upper housings 40 can be adjusted depending upon the height of a person using the toilet 26. Such size adjustment is particularly advantageous for pediatric use. While the lower housings 42 could also be slidably mounted on the tracks 22, it is preferred for the lower housings 42 to be fixedly mounted on the tracks 22 by conventional techniques such as welding. It is preferred for the lower housings 42 to be mounted about eight inches above floor level.

The upper housings 40 are preferably slidably connected to the tracks 22 by carriages 50 mounted within the tracks 22. The upper housings 40 are preferably fixedly connected (e.g., welded) to the carriages 50. Top cover plates 52 fastened to the top ends of the elongated tracks 22 prevent the carriages 50 from being slid past the top ends of the elongated tracks 22.

FIG. 2 shows a cross sectional view cut through one of the carriages 50. As shown in FIG. 2, the carriage 50 is preferably made of a plate-like material (e.g., stainless steel) that is bent into a desired configuration. The carriage 50 includes a mid portion 54 that projects outward through the slot 32 of the track 22. The carriage 50 also includes end portions 56 having ends 58 that ride along the base portion 36 of the track 22. The end portions 56 are connected to the mid portion 54 by wing portions 60. The wing portions 60 are generally parallel with respect to the mid portion 54 and abut against the inside surfaces of the front flanges 34.

The carriages 50 also preferably include clamps for selectively securing the upper housings 40 at desired locations along the lengths of the tracks 22. For example, referring again to FIG. 2, the depicted clamp includes a threaded bolt 62 having a manual turning knob 64. The bolt 62 passes through a central opening 66 defined by the mid portion 54 of the carriage 50. The bolt 62 is threaded through a nut 68 fixedly secured to the underside of the mid portion 54. A cotter pin 70 prevents the bolt 62 from being completely removed from the carriage 50.

In use, the carriage 50 is clamped at a desired location along the track 22 by threading the bolt 62 into the nut 68 such that the tip of the bolt 62 is driven against the base portion 36 of the track 22. Contact between the tip of the bolt 62 and the base portion 36 of the track 22 causes the wing portions 60 of the carriage 50 to compress against the undersides of the front flanges 34. Friction between the front flanges 34 of the track 22 and the wing portions 60 of the carriage 50 effectively lock the carriage 50 at a desired location along the track 22. If it is desired to slide the carriage 50 relative to the track 22, the bolt 62 is threaded out of the nut 68 thereby reducing the pressure between the wing portions 60 and the front flanges 34. In such a condition, the carriage 50 can be freely slid relative to the track 22.

A preferred use for the safety device 20 is to stabilize a person seated on a toilet such as the toilet 26. In use, the elevations of the upper housings 40 are adjusted by sliding the housings 40 along the vertical tracks 22. Preferably, the upper housings 40 are moved to positions/elevations that are slightly above the persons chest region (e.g., at about shoulder level while the person is seated). Once the upper housings 40 are oriented in their desired positions, the housings 40 are preferably clamped in place to resist movement relative to the tracks 22.

With the upper housings 40 clamped at the desired elevations, the upper belts 44 are preferably pulled from the upper housings 40 and looped under the persons arms. Once the upper belts 44 are looped under the persons arms, the belts are preferably pulled across the persons chest and coupled together by inserting the upper tongue 46 within its corresponding upper buckle 48. To provide additional stability, the lower belts 44 can be pulled from the lower housings 42, drawn the across the person's lap, and coupled together adjacent the person's lap region.

With regard to the foregoing description, it is to be understood that changes may be made in detail, especially in matters of the construction materials employed and the shape, size and arrangement of the parts without departing from the scope of the present invention. It is intended that the specification and depicted aspects be considered exemplary only, with a true scope and spirit of the invention being indicated by the broad meaning of the following claims.

I claim:

1. A safety system comprising:

first and second elongated tracks adapted for connection to a wall;

said first and second tracks being vertically mounted on opposite sides of a toilet;

a first housing mounted on and slidably moveable along the first track;

a first safety belt retractably mounted within the first housing;

a first coupling structure connected to the first safety belt; and a second coupling structure slidably moveable along the second track, the second coupling structure being adapted to interlock with the first coupling structure.

2. The safety system of claim 1, wherein the second coupling structure is connected to a second safety belt.

3. The safety system of claim 2, wherein the second safety belt is retractably mounted within a second housing that is slidably moveable along the second track.

4. A method for stabilizing a person on a toilet comprising:

providing a first housing positioned at a first side of the toilet;

providing a retractable first safety belt mounted within the first housing, the first safety belt including a first coupling structure;

providing a second coupling structure at a second side of the toilet that is opposite from the first side;

adjusting an elevation of the first housing relative the person;

adjusting an elevation of the second coupling structure, independent of said first housing, relative to the person; and interlocking the first and second coupling structures such that the first safety belt assists in stabilizing the person.

5. The method of claim 4, wherein the elevation of the first housing is adjusted by sliding the first housing along a vertical track.

6. The method of claim 4, wherein the elevation of the first housing is adjusted so as to be positioned slightly above the person's chest region.

7. The method of claim 4, wherein the second coupling structure is connected to a second safety belt that is retractably mounted within a second housing.

8. The method of claim 7, wherein the elevations of the first and second housings are adjusted by sliding the housings along vertical tracks positioned on opposite sides of the toilet.

9. The method of claim 8, wherein the elevations of the housings are adjusted so as to be positioned above the person's chest region, and the first and second belts are extended across the person's chest region.

10. The method of clam 9, further including extending a lower belt across the person's lap to provide additional stability.

* * * * *